US008991404B2

(12) United States Patent
Lipscomb et al.

(10) Patent No.: US 8,991,404 B2
(45) Date of Patent: Mar. 31, 2015

(54) PROCESS FOR SHREDDING A TOBACCO SHEET AND APPARATUS

(75) Inventors: Leonard W. Lipscomb, Mechanicsville, VA (US); Ricky L. Bowman, Richmond, VA (US)

(73) Assignee: Philip Morris USA Inc., Richmond, VA (US)

( * ) Notice: Subject to any disclaimer, the term of this patent is extended or adjusted under 35 U.S.C. 154(b) by 1899 days.

(21) Appl. No.: 11/907,757

(22) Filed: Oct. 17, 2007

(65) Prior Publication Data

US 2008/0099030 A1 May 1, 2008

Related U.S. Application Data

(60) Provisional application No. 60/852,407, filed on Oct. 18, 2006.

(51) Int. Cl.

| | |
|---|---|
| ***A24B 5/10*** | (2006.01) |
| ***A24B 7/06*** | (2006.01) |
| ***B02C 18/14*** | (2006.01) |
| ***B02C 18/16*** | (2006.01) |

(52) U.S. Cl.

CPC ..... *A24B 7/06* (2013.01); *B02C 18/142* (2013.01); *B02C 18/16* (2013.01)

USPC ..... 131/311; 131/290; 131/291; 241/236; 241/166; 241/167; 241/291; 241/293

(58) Field of Classification Search

None

See application file for complete search history.

(56) References Cited

U.S. PATENT DOCUMENTS

| | | | | |
|---|---|---|---|---|
| 3,894,697 | A * | 7/1975 | Lawson et al. | 241/159 |
| 4,000,748 | A * | 1/1977 | Summers | 131/291 |
| 4,068,805 | A | 1/1978 | Oswald | |
| 4,366,824 | A | 1/1983 | Rainer et al. | |
| 4,392,501 | A | 7/1983 | Newton et al. | |
| 4,702,264 | A | 10/1987 | Graves, Jr. | |
| 4,754,767 | A | 7/1988 | Graves, Jr. | |
| 4,768,527 | A | 9/1988 | Graves, Jr. | |
| 4,787,402 | A | 11/1988 | Leonard | |
| 5,071,080 | A * | 12/1991 | Herbst et al. | 241/166 |
| 5,105,836 | A | 4/1992 | Gentry et al. | |
| 5,129,408 | A | 7/1992 | Jakob et al. | |
| 5,303,720 | A | 4/1994 | Banerjee et al. | |
| 5,445,054 | A | 8/1995 | Pryor | |
| 6,241,170 | B1 * | 6/2001 | St. Clair | 241/167 |

FOREIGN PATENT DOCUMENTS

| | | | |
|---|---|---|---|
| AR | 242487 | A1 | 4/1993 |
| EP | 0 124 255 | A2 | 11/1984 |

* cited by examiner

*Primary Examiner* — Richard Crispino
*Assistant Examiner* — Phu Nguyen
(74) *Attorney, Agent, or Firm* — Buchanan Ingersoll & Rooney PC

(57) ABSTRACT

A process and apparatus for shredding tobacco sheets, especially tobacco sheets formed of reconstituted tobacco particles with guar and sugar comprises rotating opposing sets of cutter discs in a partially overlapping relation so as to establish a nip. The cutter discs have notches at spaced locations along a peripheral portion of the cutter discs. Adjacent pairs of cutter discs are spaced apart by a spacer disc with a stripper plate interposed between adjacent pairs of spaced apart cutter discs. A tobacco sheet which is fed into the nip of the sets of cutter discs is shredded by the discs.

16 Claims, 6 Drawing Sheets

PROCESS FOR SHREDDING A TOBACCO SHEET AND APPARATUS

CROSS REFERENCE TO RELATED APPLICATION

This application claims priority under 35 U.S.C. §119(e) to U.S. provisional Application No. 60/852,407, filed on Oct. 18, 2006, the entire content of which is incorporated herein by reference.

BACKGROUND

The shredding of tobacco sheet, especially reconstituted tobacco sheet into uniform pieces or shreds of a predetermined size and shape, facilitates manufacturing operations and is otherwise desirable. If the tobacco sheets include volatile flavorants, such as menthol and/or other ingredients which cause tackiness, there is a need to provide a shredding process which can operate continuously without heat build-up and/or is resistant to clogging from particle build-up.

SUMMARY

A shredding process according to an embodiment for shredding a tobacco sheet, comprises the steps of:

rotating opposing sets of cutter discs in a partially overlapping relation so as to establish a nip, said cutter discs having notches at spaced locations along a peripheral portion of said cutter discs;

spacing adjacent pairs of cutter discs of the same set of cutter discs according to a first thickness of a spacer disc;

removing extraneous tobacco from amongst said cutter discs by interposing a stripper plate between adjacent pairs of spaced apart cutter discs of the same set of cutter discs while rotating said adjacent pairs of cutter discs relative to said stripper plate, said stripper plate being maintained at a second thickness less than said first thickness; and, feeding a tobacco sheet along a path leading into said nip.

In an embodiment of the process, the spacer discs and the cutter discs rotate together.

In another embodiment of the process, the spacer discs serve as bushings for the stripper plates.

DETAILED DESCRIPTION

Figure 1:
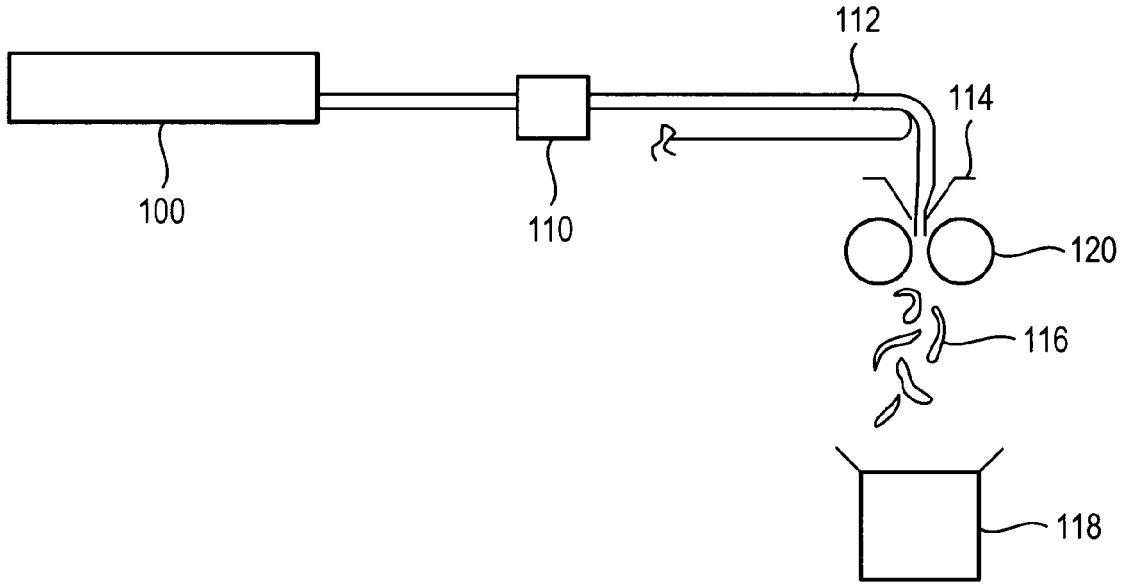
FIG. 1 is a graphical representation of an exemplary process of manufacturing a shredded tobacco sheet.

With reference to FIG. 1, a tobacco sheet is formed by mixing together tobacco particles such as tobacco dust with a binder such as guar and water in a process designated generally as 100. If desired, the tobacco dust and guar is also mixed with a liquid volatile flavorant such as menthol or additional ingredients such as sugar. These processes produce a slurry which is then dried in a drying device 110 to provide a tobacco sheet 112. The tobacco sheet is about 15 inches to about 72 inches wide and about 0.001 inches to about 0.010 inches thick. For example, the tobacco sheet can be about 0.006 inches thick and about 66 inches wide or the tobacco sheet can be about 0.006 inches thick and about 18 inches wide. The tobacco sheet is carried on an endless conveyor to a guiding device 114 provided above a shredding device 120 (i.e. sheet is substantially vertical when shredded).

The tobacco sheet formed by the process 100 and the drying device 110 is cut into generally uniform pieces 116 of a predetermined size and configuration in the shredding device 120. The uniform pieces 116 can be a various shapes and sizes depending on the configuration of the tobacco shredder. The pieces 116 of the tobacco sheet are then collected in a bin or container 118 for further processing or for use in a product such as a cigarette (not shown). If desired, the pieces 116 of the tobacco sheet may be passed through a filter (not shown) of an appropriate mesh size in order to prevent pieces which are larger than a predetermined size to be rejected.

Figure 2:
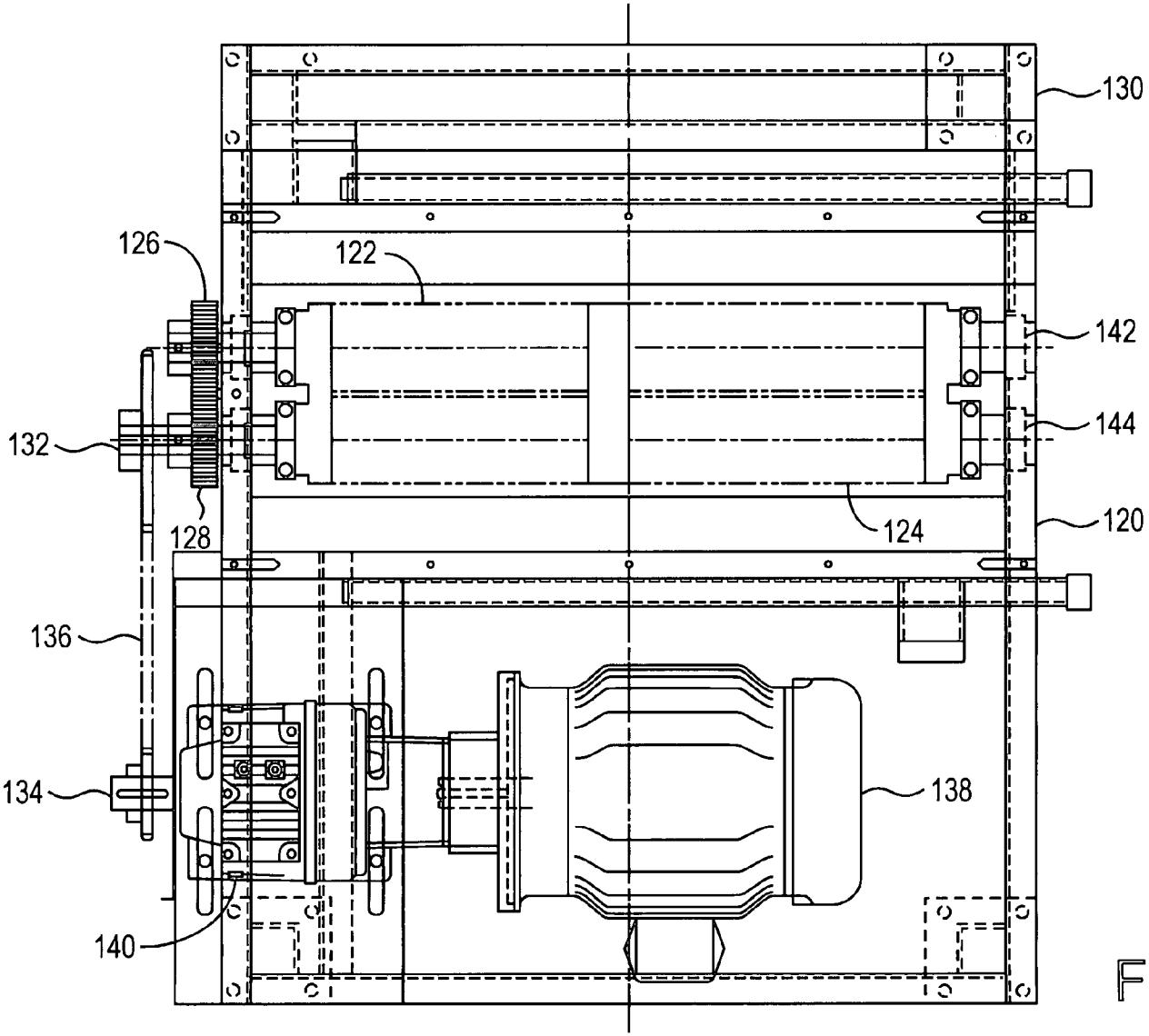
FIG. 2 is a top view of an apparatus for shredding a tobacco sheet.

With reference now to FIG. 2, a shredder 120 includes a first set of cutter discs 122 provided on a first shaft 142 alongside a second set of cutter discs 124 provided on a second shaft 144. The shredder 120 can include 500 to 3000 cutter discs 124, and more preferably about 1,500 to about 2,600 cutter discs. For example, the shredder 120 can include about 2,400 cutter discs 124. The first shaft 142 has a gear 126 keyed to the first shaft 142 and the second shaft 144 has a gear 128 keyed to the second shaft 144 with the gears engaged with one another so that rotation of the second shaft causes the first shaft to rotate in the opposite direction.

The second shaft 144 is provided with a pulley or gear 132, which is connected to another pulley or gear 134 by a belt or chain 136. The first and second shafts 142, 144 are mounted in a frame 130 by bearings or other suitable, conventional mounting arrangements in order to maintain the first and second shafts in a desired spacing with respect to one another. The pulley or gear 134 is keyed to another shaft which is connected to a motor 138 through a gearbox 140. In this way, the motor drives the first and second shafts 142, 144 at a preferred, predetermined speed to shred the tobacco sheet 112 (see, FIG. 1).

Preferably, the cutter discs rotate at a speed of about 35 rotations per minute (rpm) to about 55 rpm, and more preferably about 40 rpm to about 50 rpm. The motor can drive first shaft and the second shaft at different speeds. Preferably, the motor drives the first and second shafts 142, 144 at the same speed.

Figure 3:
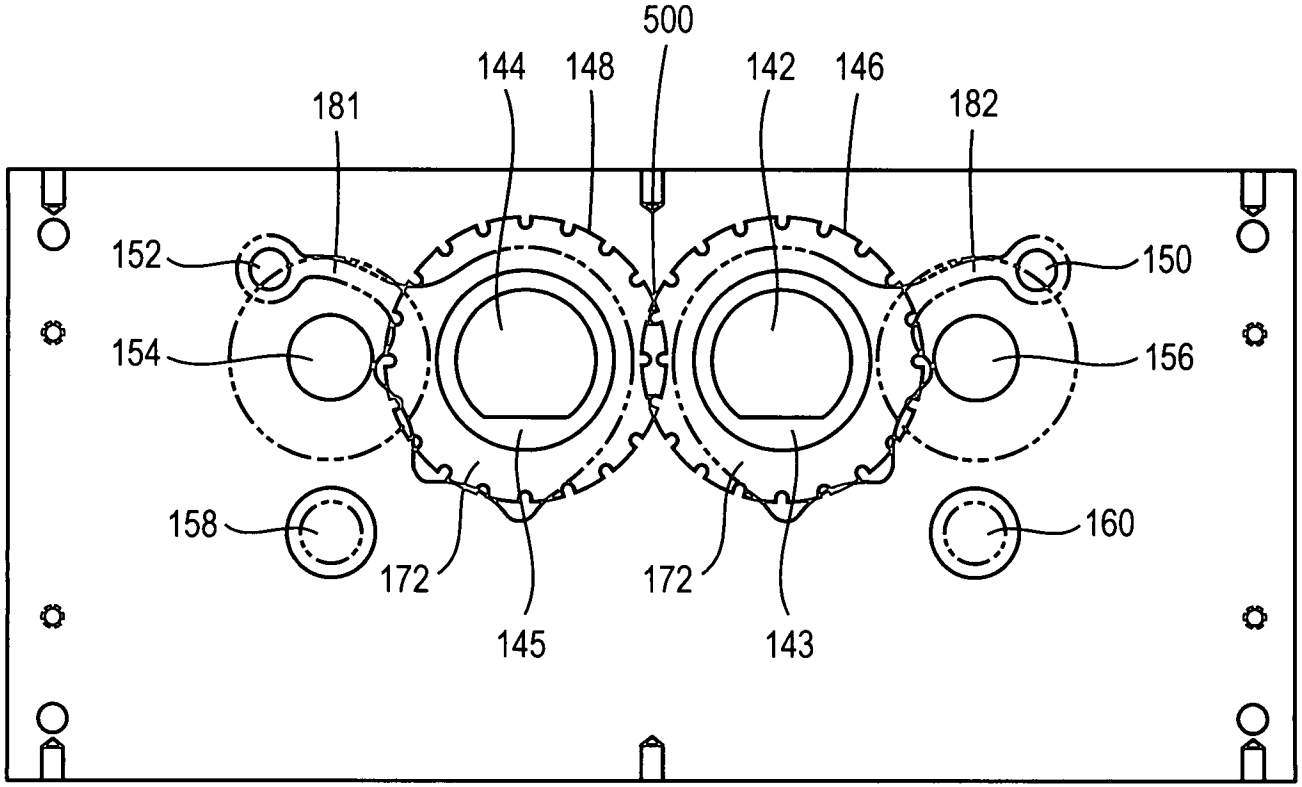
FIG. 3 is an end view of an apparatus for shredding a tobacco sheet.
Figure 4:
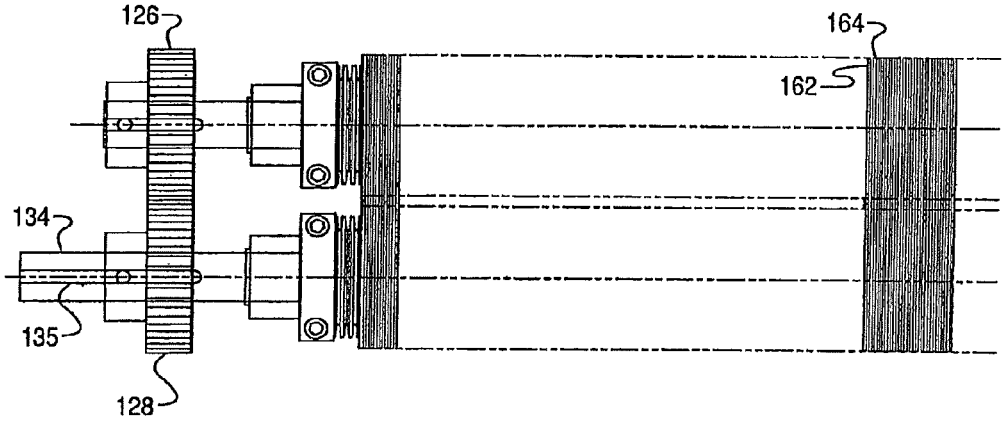
FIG. 4 is a top view of a portion of the apparatus of FIG. 3.

With reference to FIG. 3, the shafts 142, 144 are round in cross section with a flat surface provided at one portion of each shaft. The first shaft 142 carries a plurality of cutter discs 146 and the second shaft 144 carries a plurality of cutter discs 148. Adjacent cutter discs on the first shaft are spaced apart by a spacer 143 provided between each pair of adjacent cutter discs. In the same way, adjacent cutter discs on the second shaft 144 are spaced apart by a spacer 145 provided between each pair of adjacent cutter discs. In a preferred embodiment, the cutter discs are spaced about 0.01 inches to about 0.05 inches apart. The spacers have a D-shaped opening 184 (shown in FIG. 6), which corresponds to the outer surface of the respective shaft on which the spacers are carried so that the flat surface of the shafts engages the D-shaped opening of the spacers to rotate the spacers with the shafts. Similarly, the cutter discs have a D-shaped opening 170 (Shown in FIG. 5), which corresponds to the outer surface of the respective shaft on which the cutter discs are carried so that the cutter discs rotate with the shafts.

Figure 10:
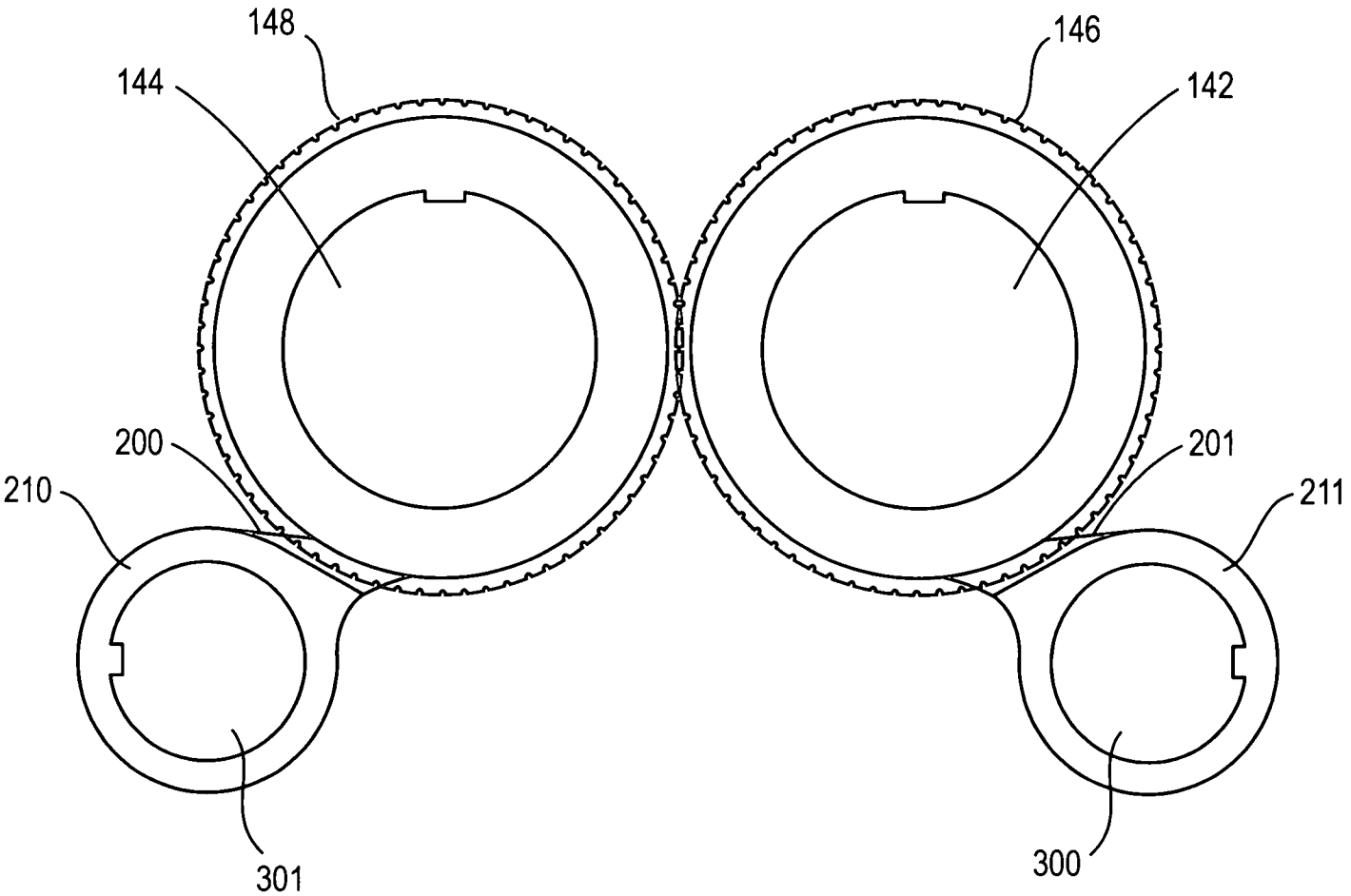
FIG. 10 is an end view of an apparatus for shredding a tobacco sheet including an internal stripper plate and an external stripper plate.

Alternatively, as shown in FIG. 10, in a preferred embodiment, the shafts 142, 144 are keyed shafts and the cutter discs 146, 148 have keyed shaft openings. The keyed shaft openings provide easy assembly because the cutter discs slide into position when placed on the shaft. The keyed shaft also provides stability to the cutter discs in that the cutter discs do not wobble.

As shown in FIG. 3, a stripper plate 172 is likewise provided between each pair of adjacent cutter discs on the first and second shafts 142, 144. Each stripper plate 172 (see also FIG. 7) has an arm 181, 182, which is carried on a respective shaft 150, 152 in order to prevent the stripper plates from rotating with the shafts 142, 144. In addition, each stripper plate 172 has a plurality of radially outwardly directed protrusions or bumps 174, 176, 178 (see FIG. 7), which extend beyond the outer surface of the adjacent cutter discs. The bumps 174, 176, 178 prevent the shredded tobacco pieces from sticking to the cutter discs and facilitate dropping of the shredded tobacco pieces 116 into the bin or container 118. Because the stripper plates are carried by the spacers 143, 145 and do not rotate with the spacers, the stripper plates each have a circular opening corresponding generally to the outer surface of the spacers 143, 145.

As seen in FIG. 3, in order to facilitate the dropping of the tobacco sheet pieces 116 (shown in FIG. 1), and to assist in cleaning of the cutter discs, first and second conduits 158, 160 are provided for directing compressed air generally toward the associated set of cutter discs. In addition first and second shafts 154, 156 are positioned so as to touch one of the bumps of the stripper plates 172 to prevent tobacco sheet pieces from sticking to either the spacers or to the cutter discs. The stripper plates have a thickness which is less than the width of the spacer on which the stripper plate is carried so that the stripper plates do not have excessive friction with the adjacent cutter discs.

Figure 7:
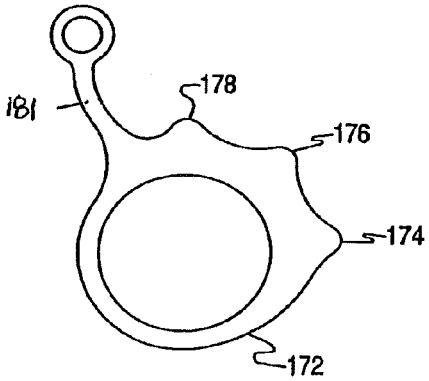
FIG. 7 is a top view of a stripper plate.
Figure 8:
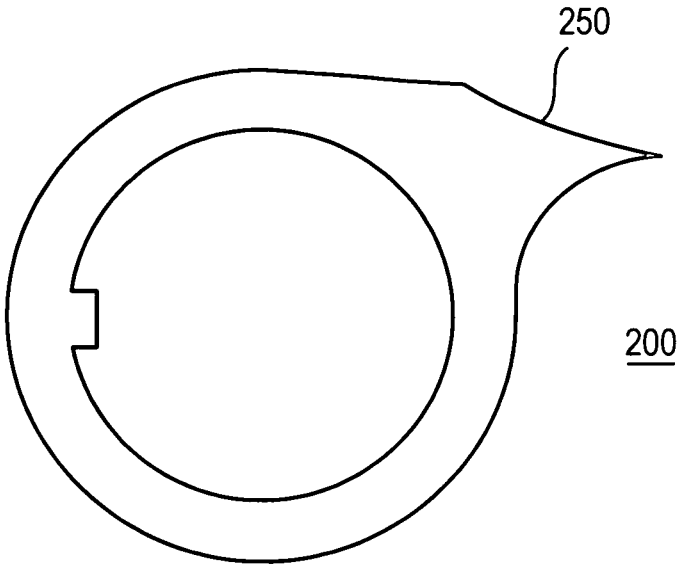
FIG. 8 is a top view of an internal stripper plate.
Figure 9:
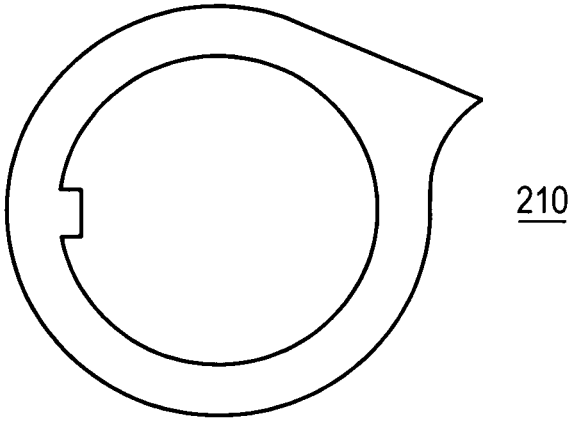
FIG. 9 is a top view of an external stripper plate.

In an embodiment, as shown in FIGS. 8, 9 and 10, an internal stripper plate 200 and an external stripper plate 210 can be used in lieu of the stripper plate 172 (shown in FIG. 7). The internal and external stripper plates are not mounted on the spacers. Instead, each internal stripper plate 200, 201 is mounted on shaft 300, 301 and fits between the cutter discs 146, 148. The internal stripper plate 200, 201 also strips out the shreds and tobacco pieces as they are formed and prevents the shreds and tobacco pieces from sticking to the cutter discs. The internal stripper plates 200, 201 also facilitate dropping of the shredded tobacco pieces into the bin or container. The internal stripper plates 200, 201 include a tobacco shred removal surface 250, which lies between the peripheral edges of each cutter disc so as to remove tobacco shreds from between the cutter discs.

Likewise, each external stripper plate 210, 211 is mounted on shaft 300, 301 and rides on the outside of the cutter discs 146, 148 of each shaft. Preferably, an external stripper plate 210, 211 is mounted on each side of the internal stripper plate 200, 201. The external stripper plates 210 clean shreds off of the peripheral edges of the cutter discs 146, 148.

In an embodiment, the internal and external stripper plates 200, 201, 210, 211 are supported by a keyed shaft 300, 301, which is fixed at both ends at the frame end plates, thereby preventing the stripper plates 200, 210 from rotating with the spacers.

Preferably, the internal and external stripper plates 200, 201, 210, 211 have a width of about 0.025 inches to about 0.028 inches. In an embodiment, for example, the center of the first keyed shaft 300 is spaced about 23.750 inches from the center of the second keyed shaft 301, and the center of the shaft 144 is spaced about 12.000 inches from the center of the shaft 142.

Especially when the tobacco sheet being shredded has menthol and sugar components, it is preferable that the shredder 120 not have significant friction between the oppositely rotating cutter discs of the two shafts 142, 144 or between the cutter discs and the stripper plates. Accordingly, the spacers 143, 145 maintain the cutter discs of the first shaft out of contact with the cutter discs of the second shaft even though the cutter discs are positioned in a partially overlapping relation so as to establish a nip 500 (Shown in FIGS. 3 and 10).

Figure 5:
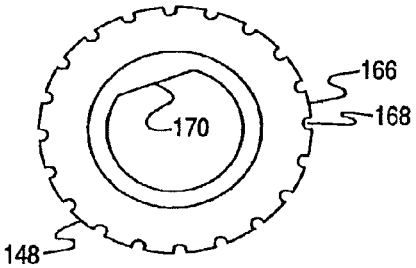
FIG. 5 is a top view of a cutter wheel.
Figure 6:
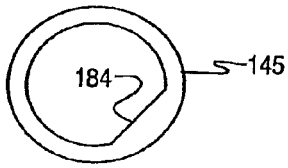
FIG. 6 is a top view of a spacer.

As shown in FIG. 5, each of the cutter discs 148 has notches 168 at spaced locations along a peripheral portion of the cutter disc 148. The curved outer surface of the cutter disc 148 between adjacent notches 168 form segments 166 which correspond generally to the length of the tobacco sheet particles formed by the shredder. In an embodiment, the notches are about 2 mm to about 5 mm wide and about 1 mm to about 5 mm deep. Preferably, the notches are spaced about 5 mm to about 15 mm apart along the cutter wheel. The notch dimensions can be changed to accommodate different shred geometries. Each cutter disc 148 has an inner flat surface 170, which corresponds to the flat surface of the respective shaft on which the cutter disc is carried so that the cutter disc rotates with the shaft.

It is believed that the cutter discs 146, 148 cut the tobacco sheet into strips corresponding generally to the distance between adjacent cutter discs 146, 148 and that the notches 168 cause the strips of the tobacco sheet to be severed or pulled apart as the notches 168 of adjacent cutter discs 146, 148 on the first 142 and second 144 shafts are positioned adjacent one another at the nip 500 between the two shafts 142, 144. In general, the surface speed of the cutter discs 146, 148 is slightly greater than the linear speed of the tobacco sheet so that the nip 500 of the cutter discs 146, 148 can pull the severed strips of the tobacco sheet apart into uniform segments or shreds.

In this way, the shredder 120 is configured for continuous operation to shred a tobacco sheet, especially a tobacco sheet which might include a volatile component such as menthol or another component that may cause tackiness. The shredder can operate continuously without generating excessive heat from friction. In an embodiment, air knives can be provided, as appropriate in order to aid removal of tobacco sheet pieces from the shredder as well as to cool the shredder. If the shredder heats excessively, the high temperature may degrade the tobacco sheet, especially a tobacco sheet which contains menthol and sugar components.

In the operation of the shredder for shredding a tobacco sheet, opposing sets of cutter discs are rotated in a partially overlapping relation so as to establish a nip. The cutter discs have notches at spaced locations along a peripheral portion of the cutter discs. The notches of the opposing sets are repetitively brought into superposed relation at the nip, more preferably the notches pass alternately through the nip as shown in FIG. 10. Adjacent pairs of cutter discs of the same set of cutter discs are spaced apart according to a first thickness of a spacer disc. Extraneous tobacco is removed from amongst the cutter discs by interposing a stripper plate between adjacent pairs of spaced apart cutter discs of the same set of cutter discs while rotating the adjacent pairs of cutter discs relative to the stripper plate. The stripper plate has a second thickness less than the first thickness. The tobacco sheet is fed along a path leading into the nip.

In an embodiment, the opposed cutter discs rotate in contact with each other at the nip as they shred the tobacco sheet. In a preferred embodiment, the opposed cutting edges of the opposed cutter discs are spaced apart and do not contact one another at the nip as the cutter discs rotate. Thus, the tobacco sheet is sheared by close non-contact of the cutter discs, which reduces friction and heat build-up.

In this specification, the word "about" is often used in connection with numerical values to indicate that mathematical precision of such values is not intended. Accordingly, it is intended that where "about" is used with a numerical value, a tolerance of 5% is contemplated for that numerical value.

Variations and modifications of the foregoing will be apparent to those skilled in the art. Such variations and modifications are to be considered within the purview and scope of the claims appended hereto.

What is claimed is:

1. A tobacco shredder comprising:

mixing apparatus operable to form a slurry from tobacco particles, tobacco dust, a binder, a liquid volatile flavorant, and optional additional ingredients;

drying apparatus operable to dry the slurry and produce a substantially continuous tobacco sheet;

a first set of cutter discs including adjacent pairs of cutter discs, each adjacent pair being separated by one of a plurality of spacer discs, provided on a first shaft, the cutter discs having notches at spaced locations along a peripheral portion thereof and each pair of cutter discs spaced apart according to a first thickness of one of the plurality of spacer discs;

a second set of cutter discs including adjacent pairs of cutter discs, each adjacent pair being separated by one of the plurality of spacer discs, provided on a second shaft and positioned alongside said first set of cutter discs, the cutter discs having notches at spaced locations along a peripheral portion thereof and each pair of cutter discs spaced apart according to the first thickness of one of the plurality of spacer discs, the substantially continuous tobacco sheet being received between the first set of cutter discs and the second set of cutter discs; and an internal stripper plate between each adjacent pair of cutter discs of the first set and the second set, said internal stripper plate having a second thickness less than said first thickness, and including a circular opening corresponding generally to an outer surface of the spacer discs, wherein each of the plurality of spacer discs cooperates with one of the internal stripper plates that does not rotate with the spacer discs, each of the internal stripper plates including an arm, which is carried by a keyed shaft so as to prevent the internal stripper plates from rotating with the first shaft and the second shaft.

2. The tobacco shredder of claim 1, wherein each of the plurality of spacer discs includes an opening corresponding to an outer surface of the first shaft or second shaft.

3. The tobacco shredder of claim 1, wherein the internal stripper plate includes at least one radially outwardly directed protrusion extending beyond an outer surface of said adjacent pair of cutter discs.

4. The tobacco shredder of claim 1, wherein an outer surface of each spacer disc fits in an opening in a respective one of the internal stripper plates.

5. The tobacco shredder of claim 1, wherein said first set of cutter discs and said second set of cutter discs rotate in a partially overlapping relation so as to establish a nip.

6. The tobacco shredder of claim 1, further including an external stripper plate.

7. The tobacco shredder of claim 1, wherein said first shaft and said second shaft include gears engaged with each other such that the first shaft and the second shaft rotate in opposite directions.

8. The tobacco shredder of claim 5, wherein said cutter discs contact each other at the nip.

9. The tobacco shredder of claim 5, wherein said cutter discs are spaced apart at the nip so as to reduce friction and/or heat build-up.

10. A tobacco shredder comprising:

mixing apparatus operable to form a slurry from tobacco particles, tobacco dust, a binder, a liquid volatile flavorant, and optional additional ingredients;

drying apparatus operable to dry the slurry and produce a substantially continuous tobacco sheet;

a first set of cutter discs including adjacent pairs of cutter discs, each adjacent pair being separated by one of a plurality of spacer discs, provided on a first shaft, the cutter discs having notches at spaced locations along a peripheral portion thereof and each pair of cutter discs spaced apart according to a first thickness of one of the plurality of spacer discs;

a second set of cutter discs including adjacent pairs of cutter discs, each adjacent pair being separated by one of a plurality of spacer discs, provided on a second shaft and positioned alongside said first set of cutter discs, the cutter discs having notches at spaced locations along a peripheral portion thereof and each pair of cutter discs spaced apart according to the first thickness of one of the plurality of spacer discs, the substantially continuous tobacco sheet being received between the first set of cutter discs and the second set of cutter discs; and an internal stripper plate between each adjacent pair of cutter discs, said internal stripper plate having a second thickness less than said first thickness, and including a circular opening corresponding generally to an outer surface of the spacer discs;

wherein said notches of said first set of cutter discs and said second set of cutter discs are alternately brought into superposed relation with said nip during rotation of said cutter discs;

wherein the tobacco sheet has a linear speed; and wherein the surface speed of the first set of cutter discs is greater than the speed of the tobacco sheet, wherein each spacer disc cooperates with one of the internal stripper plates that does not rotate with the spacer disc, each of the internal stripper plates including an arm, which is carried by a keyed shaft so as to prevent the internal stripper plates from rotating with the first shaft and the second shaft.

11. A tobacco shredder comprising:

mixing apparatus operable to form a slurry from tobacco particles, tobacco dust, a binder, a liquid volatile flavorant, and optional additional ingredients;

drying apparatus operable to dry the slurry and produce a substantially continuous tobacco sheet;

a first set of cutter discs including adjacent pairs of cutter discs, each adjacent pair being separated by one of a plurality of spacer discs, provided on a first shaft, the cutter discs having notches at spaced locations along a peripheral portion thereof and each pair of cutter discs spaced apart according to a first thickness of one of the plurality of spacer discs;

a second set of cutter discs including adjacent pairs of cutter discs, each adjacent pair being separated by one of a plurality of spacer discs, provided on a second shaft and positioned alongside said first set of cutter discs, the cutter discs having notches at spaced locations along a peripheral portion thereof and each pair of cutter discs spaced apart according to the first thickness of one of the plurality of spacer discs, the substantially continuous tobacco sheet being received between the first set of cutter discs and the second set of cutter discs;

internal stripper plates arranged to strip out shreds of tobacco from between each adjacent pair of cutter discs and having a second thickness less than said first thickness; and external stripper plates arranged to clean shreds of tobacco from the peripheral portion of said cutter discs, wherein said internal stripper plates and said external stripper cooperate with each of the spacer discs, the internal and external stripper plates being carried by a keyed shaft so as to prevent the internal stripper plates and the external stripper plates from rotating with the spacer discs.

12. The tobacco shredder of claim 11, wherein the first set of cutter discs is axially offset from the second set of cutter discs and the peripheral portions of the first set of cutter discs being positioned between the peripheral portions of the second set of cutter discs.

13. The tobacco shredder of claim 11, wherein the first set of cutter discs are rotatable about the first shaft and the second set of cutter discs are rotatable about the second shaft such that the first and second sets of cutter discs rotate in opposite directions.

14. The tobacco shredder of claim 11, wherein each of the internal stripper plates has a tobacco shred removal surface.

15. The tobacco shredder of claim 11, wherein the first distance is about 0.01 inches to about 0.05 inches.

16. The tobacco shredder of claim 11, wherein the notches are about 2 mm to about 5 mm wide and about 1 mm to about 5 mm deep, and wherein the notches are spaced about 5 mm to about 15 mm apart along the cutter discs.

* * * * *